US009903253B2

(12) United States Patent
Odillard

(10) Patent No.: US 9,903,253 B2
(45) Date of Patent: Feb. 27, 2018

(54) HEAT EXCHANGER HAVING A STRESS ABSORPTION ZONE WITH A CONVEX SURFACE

(71) Applicant: Valeo Systemes Termiques, Le Mesnil Saint Denis (FR)

(72) Inventor: Laurent Odillard, Le Luart (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 504 days.

(21) Appl. No.: 14/349,407

(22) PCT Filed: Oct. 2, 2012

(86) PCT No.: PCT/EP2012/069503

§ 371 (c)(1),
(2) Date: Apr. 3, 2014

(87) PCT Pub. No.: WO2013/050395

PCT Pub. Date: Apr. 11, 2013

(65) Prior Publication Data

US 2014/0246181 A1 Sep. 4, 2014

(30) Foreign Application Priority Data

Oct. 4, 2011 (FR) ..... 11/58953

(51) Int. Cl.
*F28D 7/10* (2006.01)
*F01P 1/06* (2006.01)
(Continued)

(52) U.S. Cl.
CPC ..... *F01P 1/06* (2013.01); *F28F 9/001* (2013.01); *F28D 2021/0082* (2013.01); *F28F 2225/02* (2013.01)

(58) Field of Classification Search
CPC ..... F01P 1/06; F28F 9/001; F28F 2225/02; F28D 2021/0082; F28D 2021/008
(Continued)

(56) References Cited

U.S. PATENT DOCUMENTS 4,461,348 A * 7/1984 Toge ..... F28F 9/0226 165/149
5,667,004 A * 9/1997 Kroetsch ..... F28F 9/001 165/149
(Continued)

FOREIGN PATENT DOCUMENTS

EP 1134510 A1 9/2001
FR 2855604 A1 12/2004
(Continued)

OTHER PUBLICATIONS

English language abstract and machine-assisted English translation for FR2855604 extracted from espacenet.com database on Jul. 7, 2014, 12 pages.
(Continued)

*Primary Examiner* — Claire Rojohn, III
(74) *Attorney, Agent, or Firm* — Howard & Howard Attorneys PLLC

(57) ABSTRACT

A heat exchanger for an automotive vehicle includes a core bundle for exchanging heat between fluids, a case for housing the core bundle, a container for collecting inlet fluid, and a container for collecting outlet fluid. The case presents at least an area for absorbing stress, adjacent to the inlet collection container, such that the case withstands mechanical stress exerted on the case when the fluid flows in the core bundle from the fluid inlet container to the fluid outlet container.

11 Claims, 1 Drawing Sheet

(51) Int. Cl.
*F28F 9/00* (2006.01)
*F28D 21/00* (2006.01)

(58) Field of Classification Search
USPC ..... 165/51, 52, 53, 157, 159, 162, 185
See application file for complete search history.

(56) References Cited

U.S. PATENT DOCUMENTS 6,675,883 B1 * 1/2004 De Keuster ..... F28F 9/0224 165/173
7,631,688 B2 * 12/2009 Brost ..... F28D 7/1684 165/157
8,844,504 B2 * 9/2014 Raduenz ..... F28D 7/1684 123/568.12
8,905,008 B2 * 12/2014 Leroux ..... F02B 29/0418 123/188.14
9,377,252 B2 * 6/2016 Garret ..... F28D 7/1684
2003/0145979 A1 8/2003 Beddome et al.
2003/0196785 A1 * 10/2003 Knecht ..... F28D 7/1684 165/148
2004/0168791 A1 * 9/2004 Batt ..... F28D 9/0037 165/165
2005/0016717 A1 * 1/2005 Lamich ..... F28F 9/001 165/149
2005/0161206 A1 * 7/2005 Ambros ..... F02B 29/0462 165/173
2006/0048759 A1 * 3/2006 Hendrix ..... F28D 7/1684 123/563
2006/0048923 A1 * 3/2006 Domen ..... F28D 9/0043 165/148
2006/0278377 A1 * 12/2006 Martins ..... F02B 29/0412 165/140
2007/0240863 A1 * 10/2007 Kim ..... F28D 1/05366 165/149
2009/0194265 A1 * 8/2009 Nakamura ..... F28D 9/0025 165/149
2011/0056652 A1 * 3/2011 Neher ..... F28D 7/1684 165/81
2011/0120151 A1 * 5/2011 Cutting ..... A01N 1/0252 62/66
2011/0168366 A1 * 7/2011 Garret ..... F28D 9/0043 165/148
2014/0231054 A1 * 8/2014 Martins ..... F02B 29/0462 165/166

FOREIGN PATENT DOCUMENTS

FR 2933176 A1 * 1/2010 ..... F28D 9/0043
WO WO2008138803 A2 11/2008
WO WO2009156365 A1 12/2009
WO WO2013050394 A1 4/2013

OTHER PUBLICATIONS

English language abstract for FR2933176 extracted from espacenetcom database on Jul. 7, 2014, 2 pages. Also see English equivalent US2011/0168366.
English language abstract for WO2009156365 extracted from espacenet.com database on Jul. 7, 2014, 2 pages. Also see English equivalent US2011/0168366.
International Search Report for PCT/EP2012/069502 dated Nov. 8, 2012, 7 pages.
International Search Report for PCT/EP2012/069503 dated Nov. 7, 2012, 5 pages.
U.S. Appl. No. 14/349,502, filed Apr. 3, 2014, 15 pages. This is the English Language Appln equivalent to WO 2013/050394.

* cited by examiner

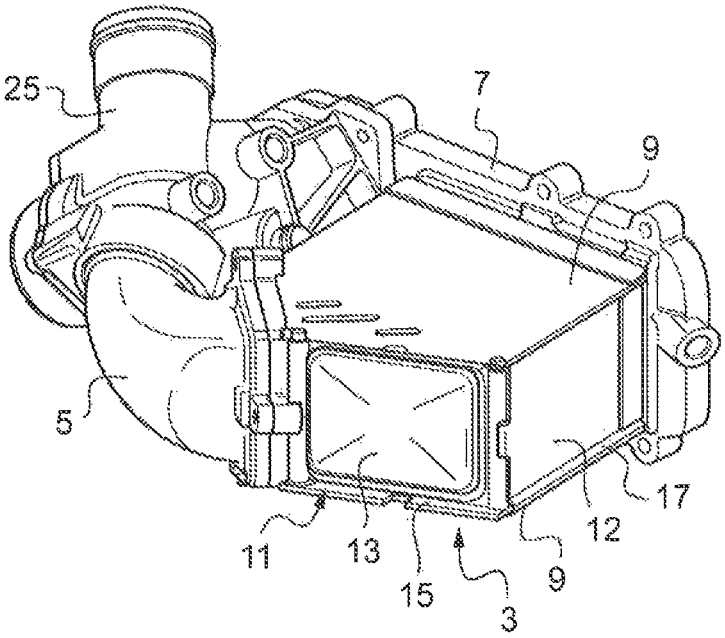
Fig.1
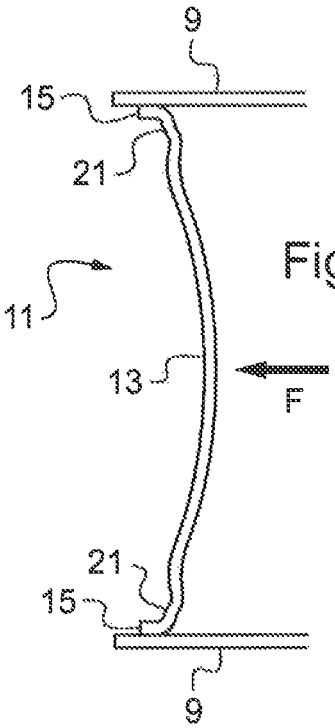
Fig.2
Fig.3
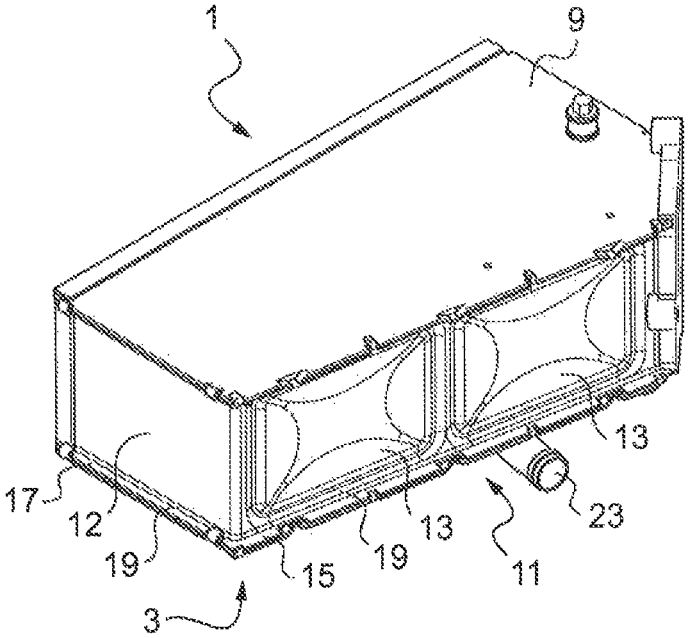

HEAT EXCHANGER HAVING A STRESS ABSORPTION ZONE WITH A CONVEX SURFACE

CROSS-REFERENCE TO RELATED APPLICATIONS

This application is a National Stage of International Patent Application No. PCT/EP2012/069503, filed Oct. 2, 2012, which claims priority to and all the advantages of French Patent Application No. FR 11/58953, filed Oct. 4,2011, the content of which is incorporated herein by reference.

The invention relates to a heat exchanger, notably for a motor vehicle.

More particularly, the invention relates to a heat exchanger for a motor vehicle engine air supply circuit.

The invention relates to the general field of the supply of air to motor vehicle engines, more particularly to engines the charge air of which comes from a compressor or a turbocharger, so that it is then referred to as supercharged charge air.

It is known practice to cool the supercharged charge air leaving the compressor using a heat exchanger which is also referred to as a charge air cooler (or CAC for short).

In this case, the CAC heat exchanger allows the supercharged engine charge air to be cooled by exchange of heat with another fluid such as external air or a liquid such as the water from the engine cooling circuit, thus forming an exchanger of the air/air or liquid/air type.

Such exchangers generally comprise a heat exchange core bundle comprising a stack of tubes or plates defining respective circulation canals for the fluids, so as to allow an exchange of heat between the two fluids circulating within the core bundle.

The core bundle is, in the known way, housed in a casing. Such a casing may comprise end plates on each side of the stack of plates or of the tubes of the core bundle defining the fluid circulation canals, and generally one or more side walls connecting these end plates.

To allow the fluid to be admitted to and then removed from the core bundle, fluid inlet and outlet header tanks are, according to a known solution, attached to the casing that houses the heat exchange core bundle.

The casing that houses the core bundle has a structural role by contributing to the rigidity of the exchanger.

However, in operation, the boost pressure may deform the casing, particularly the side walls of the casing.

This pressure leads to a level of mechanical stress which may exceed the limit of the material used.

It is known practice to increase the thickness of the material or even to provide additional components in order to withstand such mechanical stresses.

Moreover, in order notably to limit the cost of manufacture of an exchanger there is an increasing tendency toward a reduced thickness of materials. However, that leads to reduced ability to withstand the mechanical stresses.

It is an objective of the invention to propose a heat exchanger that does not have the disadvantages of the prior art.

To this end, one subject of the invention is a heat exchanger, notably for a motor vehicle, said exchanger comprising:

- a core bundle for exchanging heat between fluids,
- a casing for housing said core bundle,
- a fluid inlet header tank, and
- a fluid outlet header tank, characterized in that said casing has at least one stress absorption zone adjacent to said at least one inlet header tank so as to withstand the mechanical stresses applied to said casing as said fluid flows through said core bundle from said fluid inlet tank toward said fluid outlet tank.

Said exchanger may further comprise one or more of the following features, considered separately or in combination:

- said casing comprises at least two end plates one on each side of said core bundle in the direction of stacking of fluid circulation canals, and at least one side wall connecting said at least two end plates, and said at least one side wall has at least one stress absorption zone;
- said at least one absorption zone has at least one convex surface, the convex face facing in the general direction of stress;
- said at least one convex surface is formed substantially at the center of said at least one side wall;
- said at least one convex surface extends substantially over the whole of said at least one side wall;
- said casing comprises stiffening means formed as one with said casing;
- said stiffening means are produced by deforming said casing;
- at least one stress absorption zone comprises stiffening means;
- said at least one side wall has at least one border bent over along a bent edge for connection to an end plate, and said at least one side wall has stiffening means arranged substantially at the bent edge;
- said at least one side wall comprises stress limiting means on at least one zone of connection to an end plate;
- said at least one side wall has at least one stress limiting groove on at least one peripheral contour of said at least one side wall;
- said exchanger is configured to cool the supercharged charge air of a motor vehicle engine and in that said fluid outlet header tank is configured to admit the supercharged charge air to said engine.

Other features and advantages of the invention will become more clearly apparent from reading the following description, given by way of nonlimiting illustration, and from studying the attached drawings in which:

FIG. 1 depicts a heat exchanger,

FIG. 2 is a schematic and simplified view of a convex surface of a side wall of the casing of the exchanger of FIG. 1, and FIG. 3 depicts an alternative form of heat exchanger with a side wall that has two convex surfaces.

In these figures, elements that are substantially identical bear the same references.

FIG. 1 depicts a heat exchanger 1 notably for a motor vehicle.

This exchanger is intended to be placed in an engine air supply circuit.

Such an exchanger 1 is notably configured to cool the supercharged charge air for a combustion engine of the motor vehicle.

This exchanger 1 comprises a core bundle of tubes or plates for exchange of heat between a first fluid such as the supercharged charge air and a second fluid such as a liquid coolant.

This core bundle of tubes or plates is housed in a casing 3.

The exchanger 1 further comprises a first header tank 5 for the inlet of the first fluid, and a second header tank 7 for the outlet of the fluid.

According to the embodiment described, the outlet tank 7 is fixed to the cylinder head of the engine (the engine is not depicted) to allow cooled air to be admitted, and therefore forms an admission tank for the first fluid.

According to the example illustrated, the casing 3 comprises for example:

two end plates 9 one on each side of the core bundle in the direction of stacking of the plates or of the tubes defining the fluid circulation canals, and at least one side wall 11, 12 connecting the two end plates 9.

According to the embodiment illustrated, the exchanger 1 comprises a first side wall 11 adjacent to the inlet tank 5, and a second side wall 12.

The first side wall 11 is arranged near the inlet tank 5 and is therefore situated substantially level with the arrival of the supercharged charge air relative to the direction in which the air flows.

It is therefore referred to as a frontal wall 11 relative to the direction in which the fluid flows. The rear part of the exchanger 1 is defined by the outlet tank 7 mounted on the cylinder head of the engine (the engine is not depicted).

The side wall or walls 11, 12 have zones of connection to the end plates 9.

In the example illustrated, the side walls 11, 12 respectively have peripheral borders 15, 17 which are bent over for connection to the end plates.

These borders 15, 17 are bent over along a bent edge 19.

These borders 15, 17 are held on the end plates 9 for example by crimping.

The assembly is then for example brazed thereafter.

The casing 3 further comprises at least one stress absorption zone for withstanding the stresses applied to the casing 3 as the supercharged charge air flows.

The absorption zone or zones are arranged adjacent to the inlet tank 5.

According to the embodiment illustrated in FIG. 1, it is the first side wall 11 that has such an absorption zone.

This for example involves providing a substantially convex surface 13 on the side wall 11, as indicated schematically in FIG. 2.

The convex face is oriented in the general direction of stresses applied to the casing 3 as the supercharged charge air flows, as schematically indicated by the arrow F.

This convex surface 13 is in this instance arranged substantially at the center of the side wall 11.

In addition, this convex surface 13 extends substantially over the whole of the side wall 11.

This surface 13 therefore extends substantially over the whole height and over the whole width of the side wall 11.

Such a convex surface 13 makes it possible to limit the movements of the surface of the side wall 11 as the supercharged charge air flows from the inlet tank 5 toward the outlet tank 7.

Specifically, a side wall 11 is obtained that is more rigid and therefore better able to withstand the mechanical stresses applied to the side wall 11 as the supercharged charge air flows toward the engine (not depicted).

It is therefore possible, for the same order of ability to withstand the mechanical stresses, to provide a side wall 11 that is thinner than in the prior art. By way of example, for the same order of strength, it is possible to come down from a wall 3 mm thick to a wall 1.5 mm thick having such a convex surface 13.

According to an alternative form of the embodiment, provision may be made for the side wall 11 to have two convex surfaces 13 rather than just one, as illustrated in FIG. 3.

With these two convex surfaces 13, the side wall 11 is even stronger, making it possible to reduce the thickness of the wall 11 still further.

The casing 3 may also have stiffening means (not depicted in the figures).

These stiffening means are formed as one with the casing 3. For example, the stiffening means are produced by deforming the casing 3.

The stiffening means are, for example, formed at the stress absorption zone or zones of the casing 3.

As an alternative or in addition to the convex surface 13, the side wall 11 may have such stiffening means.

By way of example of stiffening means, mention may be made of substantially cross-shaped deformations. Such a cross-shaped deformation may be provided substantially in the center of the side wall 11 or in the center of the convex surface or surfaces 13 of the wall 11.

As an alternative, deformations produced substantially in the form of domes may be provided.

According to an alternative form of the embodiment, the first side wall 11 may have stiffening means at the bent edge 19 of the peripheral borders 15 which are bent over for connection to the end plates 9.

Such stiffening means may for example be produced by deforming the material of the wall 11, for example by forming a boss, at the bent edge 19. These stiffening means have, for example, a substantially triangular shape with its vertex level with the bent edge 19 and its base connecting the bent-over peripheral border 15 and the side wall 11. Such stiffening means are generally referred to as "bulldozers".

Furthermore, the casing 3 may comprise stress limitation means 21 in one or more zones of connection of the side wall or walls 11, 12 to the end plates 9.

According to the embodiment illustrated, the first side wall 11 comprises such limitation means 21 on its peripheral contours.

By way of example, the limitation means may comprise limitation grooves 21 (cf. FIG. 2).

According to the embodiment illustrated, the first side wall 11 therefore comprises limitation grooves 21 on its peripheral contours forming zones of connection to the end plates 9.

Moreover, the casing 3 may also comprise inlet and outlet nozzles 23 for the second fluid (cf. FIG. 3).

Referring once again to FIG. 1, the header tanks 5, 7 for their part are for example produced by molding.

The header tanks 5 and 7 are arranged in such a way that having passed through the core bundle, the cooled air leaves the exchanger 1 to be supplied to the engine.

For that, the inlet tank 5 communicates with an air inlet duct 25.

To allow cooled air to be admitted to each of the cylinders of the engine (not depicted), the outlet tank 7 is open to allow the cooled air to pass toward the engine.

The positioning of the inlet tank 5 and outlet tank 7 is given by way of illustration.

Thus, the supercharged charge air enters the exchanger 1 via the inlet tank 5 for the first fluid, circulates through the heat-exchange core bundle 3 then leaves the exchanger 1 via the outlet tank 7 for the first fluid so as to be fed to the engine (not depicted).

As for the second fluid, that enters the heat-exchange core bundle via an inlet nozzle 23 for the second fluid, circulates through the heat-exchange core bundle to exchange heat with the supercharged charge air that is to be cooled and then leaves the heat-exchange core bundle via an outlet nozzle 23 for the second fluid.

It will therefore be appreciated that such a heat exchanger casing 3 for admitting supercharged charge air to the combustion engine is better able to withstand the stresses applied as the air flows through the exchanger 1 because of the absorption zone provided for example by one or more convex surfaces of the side wall 11 adjacent to the inlet tank 5 and/or because of the variable-geometry deformations of this side wall 11.

The invention claimed is:

1. A heat exchanger for cooling supercharged charge air for an engine of a motor vehicle, said exchanger comprising:

a core bundle for exchanging heat between fluids;

a casing (3) for housing said core bundle, wherein said casing (3) comprises at least two end plates (9), and five side walls (11) connecting said at least two end plates (9), a fluid inlet header tank (5); and a fluid outlet header tank (7) configured to admit the supercharged charge air to the engine:

wherein said casing (3) has at least one stress absorption zone adjacent to said fluid inlet header tank (5) so as to withstand mechanical stresses applied to said casing (3) as fluid flows through said core bundle from said fluid inlet header tank (5) toward said fluid outlet header tank (7); and wherein said at least one stress absorption zone has at least one convex surface (13), with said at least one convex surface (13) facing an interior of said casing (3); and at least one side wall (11) adjacent to the inlet header tank has said at least one stress absorption zone and said at least one convex surface (13) is curved and extends over a whole of said at least one side wall (11).

2. The exchanger as claimed in claim 1, wherein said at least one convex surface (13) is formed at a center of said at least one side wall (11).

3. The exchanger as claimed in claim 1, wherein said at least one side wall (11) has at least one border (15) bent over along a bent edge (19) for connection to an end plate (9).

4. The exchanger as claimed in claim 1, wherein said at least one side wall (11) comprises stress limiting means on at least one zone of connection to an end plate (9).

5. The exchanger as claimed in claim 4, wherein said at least one side wall (11) has at least one stress limiting groove (21) on at least one peripheral contour of said at least one side wall (11).

6. A heat exchanger for cooling supercharged charge air for an engine of a motor vehicle, said exchanger comprising: a core bundle for exchanging heat between fluids; a casing (3) for housing said core bundle; a fluid inlet header tank (5); and a fluid outlet header tank (7) configured to admit the supercharged charge air to the engine;

wherein said casino (3) has at least one stress absorption zone adjacent to said fluid inlet header tank (5) so as to withstand mechanical stresses applied to said casing (3) as fluid flows through said core bundle from said fluid inlet header tank (5) toward said fluid outlet header tank (7); and wherein said at least one stress absorption zone has at least one convex surface (13) that is curved, with said at least one convex surface (13) facing an interior of sad casing (3); and wherein said casing (3) comprises at least two end plates (9), and five side wails (11) connecting said at least two end plates (9), and at least one side wall (11) has said at least one stress absorption zone.

7. The exchanger as claimed in claim 6, wherein said at least one convex surface (13) is formed at a center of said at least one side wall (11).

8. The exchanger as claimed in claim 6, wherein said at least one convex surface (13) extends over a whole of said at least one side wall (11).

9. The exchanger as claimed in claim 6, wherein said at least one side wall (11) has at least one border (15) bent over along a bent edge (19) for connection to an end plate (9).

10. The exchanger as claimed in claim 6, wherein said at least one side wall (11) comprises stress limiting means on at least one zone of connection to an end plate (9).

11. The exchanger as claimed in claim 10, wherein said at least one side wall (11) has at least one stress limiting groove (21) on at least one peripheral contour of said at least one side wall (11).

* * * * *